US008781366B2

(12) United States Patent
Motomura

(10) Patent No.: US 8,781,366 B2
(45) Date of Patent: Jul. 15, 2014

(54) IMAGE FORMATION APPARATUS

(75) Inventor: Mikio Motomura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 141 days.

(21) Appl. No.: 13/593,869

(22) Filed: Aug. 24, 2012

(65) Prior Publication Data

US 2013/0051855 A1 Feb. 28, 2013

(30) Foreign Application Priority Data

Aug. 25, 2011 (JP) ..... 2011-183239

(51) Int. Cl.
*G03G 21/00* (2006.01)

(52) U.S. Cl.
USPC ..... 399/128; 399/159

(58) Field of Classification Search
USPC ..... 399/38, 46, 48, 127, 128, 159; 430/58.05, 58.7, 58.8, 66
See application file for complete search history.

(56) References Cited

U.S. PATENT DOCUMENTS 7,906,261 B2 * 3/2011 Yagi et al. ..... 430/66
8,103,191 B2 * 1/2012 Nukada et al. ..... 399/159
8,206,881 B2 * 6/2012 Obata et al. ..... 430/58.35
8,574,798 B2 * 11/2013 Iwanaga et al. ..... 430/66
8,609,310 B2 * 12/2013 Takimoto et al. ..... 430/58.7

FOREIGN PATENT DOCUMENTS

JP 2005-208223 A 8/2005
JP 2011-48217 A 3/2011

* cited by examiner

*Primary Examiner* — Hoan Tran
(74) *Attorney, Agent, or Firm* — Marvin A. Motsenbocker; MOTS Law, PLLC

(57) ABSTRACT

An image formation apparatus includes a photoreceptor, a charge unit, an exposure unit, a development unit, and a transfer unit. The photoreceptor satisfies the following formulas.

$$0.9 \leq (|V_0(2)-VL|)/(|V_0(1)-VL|) \leq 1.0$$

$$2.0 \leq |VL|/L \leq 3.5$$

VL denotes a post-exposure surface potential value [V] of a surface portion of the photoreceptor exposed by the exposure unit in a first image formation cycle; $V_0(2)$ denotes a charge potential value [V] in a second image formation cycle of a surface portion of the photoreceptor exposed by the exposure unit in the first image formation cycle; $V_0(1)$ denotes a charge potential value [V] in a second image formation cycle of a surface portion of the photoreceptor not exposed by the exposure unit in the first image formation cycle; and L denotes a film thickness [μm] of the photosensitive layer.

15 Claims, 13 Drawing Sheets

FIG.9

[GHOST EVALUATION RESULTS]

| SAMPLE | \|VL\| | \|VL(2)\| | \|VL(1)\| | L | $(\|V_0(2) - VL\|) / (\|V_0(1) - VL\|)$ | \|VL\| / L | GHOST LEVEL |
|---|---|---|---|---|---|---|---|
| SAMPLE 1 | 42 | 426 | 476 | 20 | 0.88 | 2.1 | × (POSITIVE) |
| SAMPLE 2 | 34 | 430 | 482 | 20 | 0.88 | 1.7 | × (POSITIVE) |
| SAMPLE 3 | 57 | 435 | 473 | 20 | 0.91 | 2.9 | ○ |
| SAMPLE 4 | 63 | 442 | 464 | 20 | 0.95 | 3.2 | ○ |
| SAMPLE 5 | 45 | 456 | 468 | 20 | 0.97 | 2.3 | ○ |
| SAMPLE 6 | 56 | 460 | 466 | 20 | 0.99 | 2.8 | ○ |
| SAMPLE 7 | 57 | 471 | 472 | 15 | 1.00 | 3.8 | × (NEGATIVE) |
| SAMPLE 8 | 44 | 463 | 480 | 15 | 0.96 | 2.9 | ○ |
| SAMPLE 9 | 53 | 474 | 475 | 15 | 1.00 | 3.5 | ○ |
| SAMPLE 10 | 30 | 452 | 482 | 15 | 0.93 | 2.0 | ○ |
| SAMPLE 11 | 38 | 460 | 489 | 15 | 0.94 | 2.5 | ○ |
| SAMPLE 12 | 27 | 442 | 481 | 15 | 0.91 | 1.8 | × (POSITIVE) |

FIG.10-1

[GHOST EVALUATION RESULTS IN INITIAL PRINTING]

| SAMPLE | 0 μJ/cm² GHOST LEVEL | 0.5 μJ/cm² GHOST LEVEL | 0.6 μJ/cm² GHOST LEVEL | 1.2 μJ/cm² GHOST LEVEL | 2.4 μJ/cm² GHOST LEVEL | 4.8 μJ/cm² GHOST LEVEL | 5.0 μJ/cm² GHOST LEVEL | 7.2 μJ/cm² GHOST LEVEL |
|---|---|---|---|---|---|---|---|---|
| SAMPLE 1 | × (POSITIVE) | × (POSITIVE) | × (POSITIVE) | × (POSITIVE) | × (POSITIVE) | × (POSITIVE) | × (POSITIVE) | × (POSITIVE) |
| SAMPLE 2 | × (POSITIVE) | × (POSITIVE) | × (POSITIVE) | × (POSITIVE) | × (POSITIVE) | × (POSITIVE) | × (POSITIVE) | × (POSITIVE) |
| SAMPLE 3 | × (POSITIVE) | ○ | ○ | ○ | ○ | ○ | ○ | ○ |
| SAMPLE 4 | × (POSITIVE) | ○ | ○ | ○ | ○ | ○ | ○ | ○ |
| SAMPLE 5 | × (POSITIVE) | ○ | ○ | ○ | ○ | ○ | ○ | ○ |
| SAMPLE 6 | × (POSITIVE) | ○ | ○ | ○ | ○ | ○ | ○ | ○ |
| SAMPLE 7 | × (NEGATIVE) | × (NEGATIVE) | × (NEGATIVE) | × (NEGATIVE) | × (NEGATIVE) | × (NEGATIVE) | × (NEGATIVE) | × (NEGATIVE) |
| SAMPLE 8 | × (POSITIVE) | ○ | ○ | ○ | ○ | ○ | ○ | ○ |
| SAMPLE 9 | × (POSITIVE) | ○ | ○ | ○ | ○ | ○ | ○ | ○ |
| SAMPLE 10 | × (POSITIVE) | ○ | ○ | ○ | ○ | ○ | ○ | ○ |
| SAMPLE 11 | × (POSITIVE) | ○ | ○ | ○ | ○ | ○ | ○ | ○ |
| SAMPLE 12 | × (POSITIVE) | × (NEGATIVE) | × (POSITIVE) | × (POSITIVE) | × (POSITIVE) | × (POSITIVE) | × (NEGATIVE) | × (POSITIVE) |

FIG.10-2

[OTHER PRINTING QUALITY EVALUATION RESULTS IN INITIAL PRINTING]

| SAMPLE | 0 μJ/cm² OTHER PRINTING LEVEL | 0.5 μJ/cm² OTHER PRINTING LEVEL | 0.6 μJ/cm² OTHER PRINTING LEVEL | 1.2 μJ/cm² OTHER PRINTING LEVEL | 2.4 μJ/cm² OTHER PRINTING LEVEL | 4.8 μJ/cm² OTHER PRINTING LEVEL | 5.0 μJ/cm² OTHER PRINTING LEVEL | 7.2 μJ/cm² OTHER PRINTING LEVEL |
|---|---|---|---|---|---|---|---|---|
| SAMPLE 1 | ○ | ○ | ○ | ○ | ○ | ○ | ○ | ○ |
| SAMPLE 2 | ○ | ○ | ○ | ○ | ○ | ○ | ○ | ○ |
| SAMPLE 3 | ○ | ○ | ○ | ○ | ○ | ○ | ○ | ○ |
| SAMPLE 4 | ○ | ○ | ○ | ○ | ○ | ○ | ○ | ○ |
| SAMPLE 5 | ○ | ○ | ○ | ○ | ○ | ○ | ○ | ○ |
| SAMPLE 6 | ○ | ○ | ○ | ○ | ○ | ○ | ○ | ○ |
| SAMPLE 7 | ○ | ○ | ○ | ○ | ○ | ○ | ○ | ○ |
| SAMPLE 8 | ○ | ○ | ○ | ○ | ○ | ○ | ○ | ○ |
| SAMPLE 9 | ○ | ○ | ○ | ○ | ○ | ○ | ○ | ○ |
| SAMPLE 10 | ○ | ○ | ○ | ○ | ○ | ○ | ○ | ○ |
| SAMPLE 11 | ○ | ○ | ○ | ○ | ○ | ○ | ○ | ○ |
| SAMPLE 12 | ○ | ○ | ○ | ○ | ○ | ○ | ○ | ○ |

FIG.11-1

[GHOST EVALUATION RESULTS AFTER PRINTING 20K SHEETS]

| SAMPLE | 0 μJ/cm² | 0.5 μJ/cm² | 0.6 μJ/cm² | 1.2 μJ/cm² | 2.4 μJ/cm² | 4.8 μJ/cm² | 5.0 μJ/cm² | 7.2 μJ/cm² |
|---|---|---|---|---|---|---|---|---|
| | GHOST LEVEL | GHOST LEVEL | GHOST LEVEL | GHOST LEVEL | GHOST LEVEL | GHOST LEVEL | GHOST LEVEL | GHOST LEVEL |
| SAMPLE 1 | × (POSITIVE) | × (POSITIVE) | × (POSITIVE) | × (POSITIVE) | × (POSITIVE) | × (POSITIVE) | × (POSITIVE) | × (POSITIVE) |
| SAMPLE 2 | × (POSITIVE) | × (POSITIVE) | × (POSITIVE) | × (POSITIVE) | × (POSITIVE) | × (POSITIVE) | × (POSITIVE) | × (POSITIVE) |
| SAMPLE 3 | × (POSITIVE) | ○ | ○ | ○ | ○ | ○ | ○ | ○ |
| SAMPLE 4 | × (POSITIVE) | ○ | ○ | ○ | ○ | ○ | ○ | ○ |
| SAMPLE 5 | × (POSITIVE) | × (POSITIVE) | ○ | ○ | ○ | ○ | × (POSITIVE) | × (POSITIVE) |
| SAMPLE 6 | × (POSITIVE) | ○ | ○ | ○ | ○ | ○ | ○ | ○ |
| SAMPLE 7 | × (NEGATIVE) | × (NEGATIVE) | × (NEGATIVE) | × (NEGATIVE) | × (NEGATIVE) | × (NEGATIVE) | × (NEGATIVE) | × (NEGATIVE) |
| SAMPLE 8 | × (POSITIVE) | ○ | ○ | ○ | ○ | ○ | ○ | ○ |
| SAMPLE 9 | × (POSITIVE) | × (POSITIVE) | ○ | ○ | ○ | ○ | × (NEGATIVE) | × (NEGATIVE) |
| SAMPLE 10 | × (POSITIVE) | × (POSITIVE) | ○ | ○ | ○ | ○ | × (POSITIVE) | × (POSITIVE) |
| SAMPLE 11 | × (POSITIVE) | ○ | ○ | ○ | ○ | ○ | ○ | ○ |
| SAMPLE 12 | × (POSITIVE) | × (NEGATIVE) | × (POSITIVE) | × (POSITIVE) | × (POSITIVE) | × (POSITIVE) | × (NEGATIVE) | × (POSITIVE) |

FIG.11-2

[OTHER PRINTING QUALITY EVALUATION RESULTS AFTER PRINTING 20K SHEETS]

| SAMPLE | 0 μJ/cm² OTHER PRINTING LEVEL | 0.5 μJ/cm² OTHER PRINTING LEVEL | 0.6 μJ/cm² OTHER PRINTING LEVEL | 1.2 μJ/cm² OTHER PRINTING LEVEL | 2.4 μJ/cm² OTHER PRINTING LEVEL | 4.8 μJ/cm² OTHER PRINTING LEVEL | 5.0 μJ/cm² OTHER PRINTING LEVEL | 7.2 μJ/cm² OTHER PRINTING LEVEL |
|---|---|---|---|---|---|---|---|---|
| SAMPLE 1 | o | o | o | o | o | o | × | × |
| SAMPLE 2 | o | o | o | o | o | o | o | × |
| SAMPLE 3 | o | o | o | o | o | o | o | × |
| SAMPLE 4 | o | o | o | o | o | o | × | × |
| SAMPLE 5 | o | o | o | o | o | o | × | × |
| SAMPLE 6 | o | o | o | o | o | o | o | × |
| SAMPLE 7 | o | o | o | o | o | o | o | × |
| SAMPLE 8 | o | o | o | o | o | o | × | × |
| SAMPLE 9 | o | o | o | o | o | o | × | × |
| SAMPLE 10 | o | o | o | o | o | o | o | × |
| SAMPLE 11 | o | o | o | o | o | o | o | × |
| SAMPLE 12 | o | o | o | o | o | o | × | × |

IMAGE FORMATION APPARATUS

CROSS REFERENCE TO RELATED APPLICATIONS

This application claims priority based on 35 USC 119 from prior Japanese Patent Application No. 2011-183239 filed on Aug. 25, 2011, entitled "IMAGE FORMATION APPARATUS", the entire contents of which are incorporated herein by reference.

BACKGROUND OF THE INVENTION

1. Field of the Invention

The invention relates to image formation apparatuses, such as a printer, a copy machine, and a facsimile machine, configured to form images by electrophotographic processing.

2. Description of Related Art

In general electrophotographic processing, an image is formed by repeating steps of: evenly charging, by a charge unit, the surface of a photoreceptor as an image carrier; exposing the surface of the photoreceptor charged in the charge step to light by an exposure unit to form an electrostatic latent image based on inputted print data; developing, by a development unit, the electrostatic latent image formed in the exposure step to form a developer image; and transferring the developer image formed in the development step, to a predetermined printing medium by a transfer unit.

The conventional image formation apparatus may generate an image defect called a ghost (refer to Japanese Patent Application Publication No. 2011-48217).

SUMMARY OF THE INVENTION

An object of an embodiment of the invention is to effectively suppress the occurrence of ghosts.

An aspect of the invention is an image formation apparatus including: a photoreceptor; a charge unit; an exposure unit; a development unit; and a transfer unit. The photoreceptor satisfies both of the following formulas.

$$0.9 \leq (|V_0(2)-VL|)/(|V_0(1)-VL|) \leq 1.0$$

$$2.0 \leq |VL|/L \leq 3.5$$

VL denotes a post-exposure surface potential value [V] of a surface portion of the photoreceptor exposed by the exposure unit in a first image formation cycle. $V_0(2)$ denotes the charge potential value [V] in a second image formation cycle of a surface portion of the photoreceptor exposed by the exposure unit in the first image formation cycle. $V_0(1)$ denotes the charge potential value [V] in a second image formation cycle of a surface portion of the photoreceptor not exposed by the exposure unit in the first image formation cycle. L denotes a film thickness [μm] of the photosensitive layer.

According to this aspect, it is possible to effectively suppress occurrence of ghosts.

BRIEF DESCRIPTION OF THE DRAWINGS

FIG. 9 is a table showing a result of a ghost-level evaluation.

FIGS. 10-1 and 10-2 are tables showing a result of a ghost occurrence evaluation at the time of an initial printing, and a table showing a result of an evaluation on printing quality other than from ghost occurrence at the time of the initial printing.

FIGS. 11-1 and 11-2 are tables showing a result of a ghost occurrence evaluation after printing 20K sheets (plate life), and a table showing a result of an evaluation on printing quality other than from ghost occurrence after printing 20K sheets (plate life).

DETAILED DESCRIPTION OF EMBODIMENTS

Figure 1:
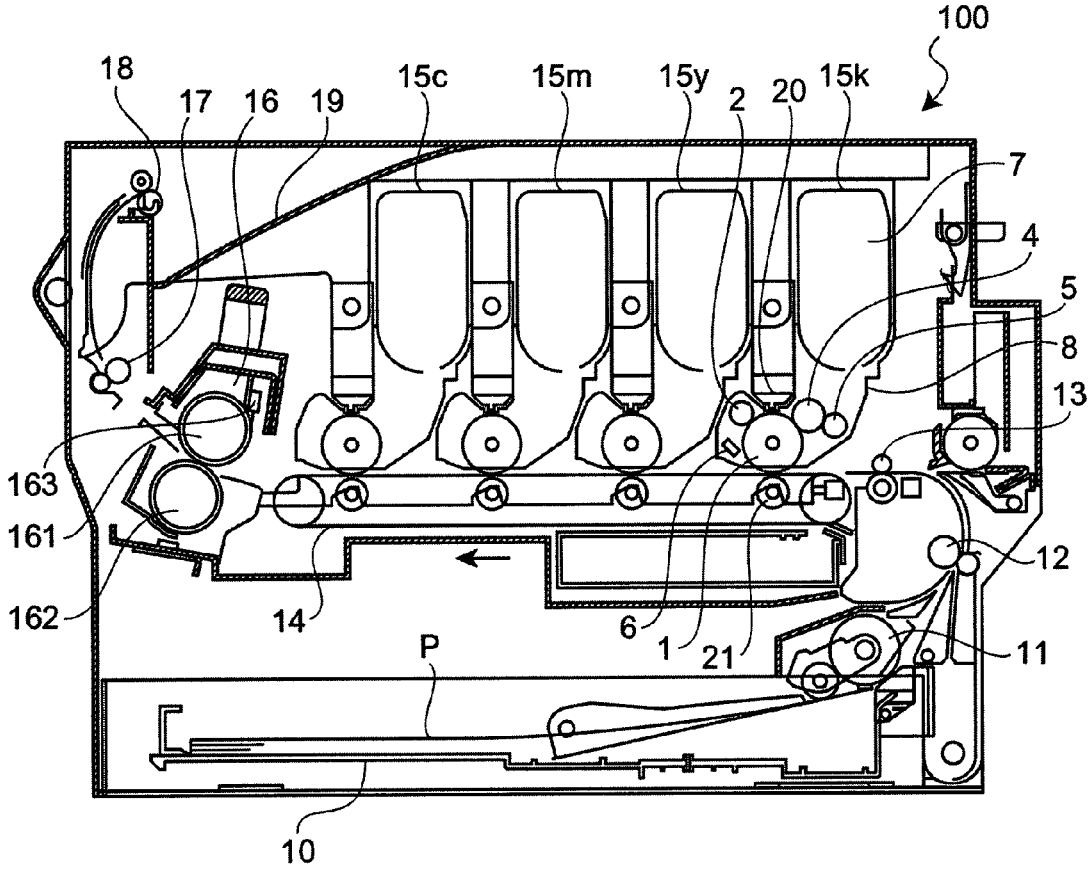
FIG. 1 is a schematic-cross sectional view for explaining an overall configuration of a printer.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

First Embodiment

FIG. 1 is a schematic-cross sectional view for explaining a schematic configuration of printer 100 serving as an image formation apparatus according to the invention. Printer 100 is a color printer capable of printing a color image obtained through electrophotographic processing, to print medium P serving as a transfer target.

Along a sheet conveyance path formed in an approximate S shape starting from feeder cassette 10 for accommodating print medium P before print, and ending at delivery unit 19 formed of an outer frame of printer 100, printer 100 includes feeder roller 11, conveyance roller 12, conveyance roller 13, transfer belt 14, fixture unit 16, conveyance roller 17 and delivery roller 18.

Moreover, on a top surface of transfer belt 14, four independent image formation units 15*k*, 15*y*, 15*m*, and 15*c* are mounted attachably to and detachably from the main body of printer 100 in this order from the upstream of the sheet conveyance path. The four independent image formation units 15*k*, 15*y*, 15*m* and 15*c* respectively accommodate toners T serving as black (k), yellow (y), magenta (m), and cyan (c) developers. Additionally, exposure LED head 20, serving as an exposure unit configured to irradiate the surface of photosensitive drum 1 with light based on inputted print data, is disposed directly above photosensitive drum 1 serving as a photoreceptor provided to each later-described image formation unit. In addition, transfer roller 21, serving as a transfer unit configured to transfer a toner image formed on photosensitive drum 1 onto print medium P, is disposed to face photosensitive drum 1 with the top surface of transfer belt 14 in between. The toner image serves as a developer image in later steps.

Feeder cassette 10 is configured to accommodate print medium P in a stacked manner, and is mounted attachably to and detachably from a lower part of printer 100. Moreover, feeder roller 11, provided to an upper part of feeder cassette 10, is configured to feed out print medium P onto the sheet conveyance path, one sheet at a time, from the top of the stack accommodated in feeder cassette 10.

Conveyance roller 12 is configured to nip and convey print medium P fed out by feeder roller 11. In addition, conveyance roller 13 is configured to correct obliqueness of print medium P conveyed by conveyance roller 12, and convey print medium P to transfer belt 14.

Transfer belt 14 is an endless belt member configured to electrostatically adsorb print medium P and convey it in a direction indicated by an arrow in FIG. 1.

Each of image formation units 15*k*, 15*y*, 15*m* and 15*c* is configured to attach toner T onto an electrostatic latent image formed on the surface of photosensitive drum 1 by light emitted from exposure LED head 20, and thereby form a toner image. Details of image formation units 15*k*, 15*y*, 15*m* and 15*c* are described later.

Fixture unit 16 is disposed downstream of image formation units 15*k*, 15*y*, 15*m* and 15*c* in the sheet conveyance path, and includes, among other things, fixture roller 161, pressure roller 162, and thermistor 163. Fixture roller 161 is formed, for example, by covering a hollow cylindrical core bar made of aluminum or the like with a heat-resistant elastic layer of silicone rubber, and coating it with a PFA (Tetrafluoroethylene-perfluoroalkyl vinyl ether copolymer) tube. Moreover, a heater such as a halogen lamp is provided inside the core bar, for example. Pressure roller 162 is formed, for example, by covering a core bar made of aluminum or the like with a heat-resistant elastic layer of silicone rubber and coating it with PFA. In addition, pressure roller 162 is disposed to form a pressure contact part between itself and fixture roller 161 by the pressure of a spring. Thermistor 163 is a surface temperature detection device configured to detect the surface temperature of fixture roller 161, and is disposed near fixture roller 161 while not being in contact with fixture roller 161. The surface temperature of fixture roller 161 is kept at a predetermined temperature by controlling the aforementioned heater according to the surface temperature of fixture roller 161 detected by thermistor 163. Print medium P with the transferred toner image on it as formed by image formation units 15*k*, 15*y*, 15*m*, and 15*c*, passes through the pressure contact part formed of fixture roller 161 and pressure roller 162, with fixture roller 161 being kept at a predetermined temperature. Thus, heat and pressure are applied to toners T on print medium P to melt toners T, and in this way the toner image is fixed.

Conveyance roller 17 is configured to nip and convey print medium P having passed fixture unit 16. In addition, delivery roller 18 is configured to deliver print medium P, conveyed by conveyance roller 17, to delivery unit 19 formed of the outer frame of printer 100.

Exposure LED head 20 is an LED head including LED elements and a lens array. Exposure LED head is disposed at a position enabling light emitted from the LED element to produce an image on the surface of photosensitive drum 1, the light being based on print data.

Transfer roller 21 is disposed to face photosensitive drum 1 with the top surface of transfer belt 14 in between. In addition, transfer roller 21 is configured to transfer a toner image formed on photosensitive drum 1 onto print medium P, according to a certain bias voltage applied from a high-voltage power supply.

Figure 2:
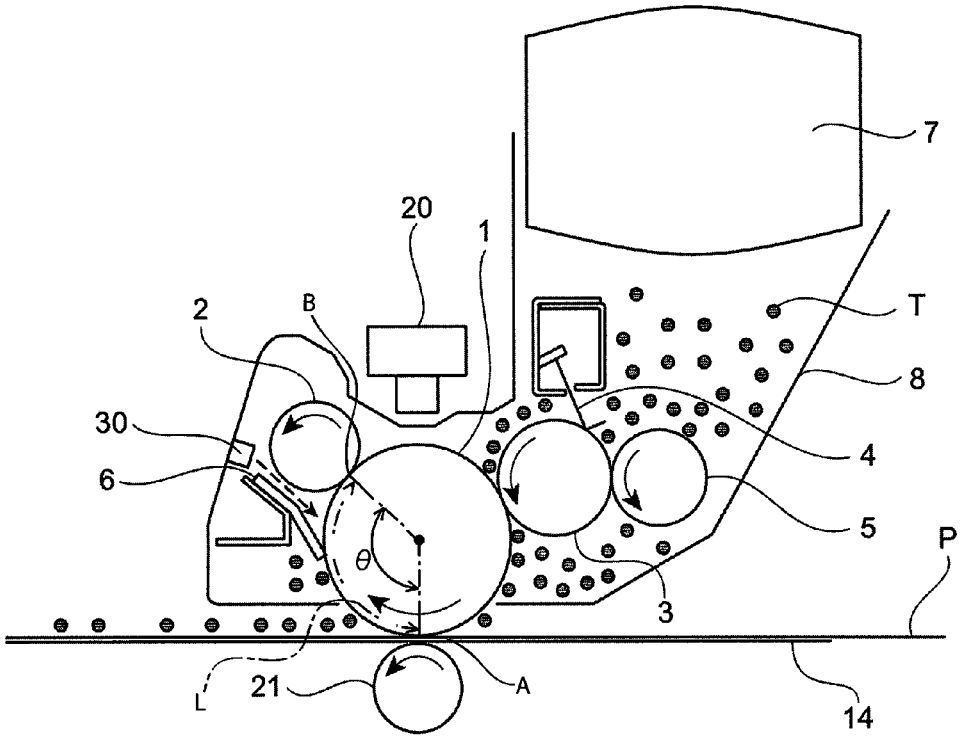
FIG. 2 is a schematic-cross sectional view for explaining an overall configuration of an image formation unit.

Next, image formation units 15*k*, 15*y*, 15*m*, and 15*c* are described with reference to FIG. 2. FIG. 2 is a schematic configuration diagram for explaining a configuration of the image formation unit. Note that image formation units 15*k*, 15*y*, 15*m*, and 15*c* have the same configuration apart from toner T to be accommodated. For this reason, image formation unit 15*k* is used as an example, and subscripts k, y, m, and c indicating the respective colors of toners T are omitted in the following description.

Image formation unit 15 is configured to form a toner image by attaching toners T to an electrostatic latent image, which is formed on the surface of photosensitive drum 1 by light emitted from exposure LED head 20. Image formation unit 15 configured in this manner includes toner cartridge 7 and drum cartridge 8.

Toner cartridge 7 is a box-type container accommodating toner T, and is configured to feed accommodated toner T to sponge roller 5 in drum cartridge 8, through a feed port provided to a bottom part of the container.

Drum cartridge 8 includes photosensitive drum 1 serving as a photoreceptor, charge roller 2 serving as a charge unit, development roller 3 serving as a development unit, development blade 4, sponge roller 5, cleaning blade 6, and optical static eliminator 30 serving as a charge elimination unit.

Photosensitive drum 1 is an organic photoreceptor formed of a conductive substrate and a photoconductive layer serving as a photosensitive layer. Photosensitive drum 1 is configured to form an electrostatic latent image based on light emitted from exposure LED head 20, while rotating in a direction indicated by an arrow in FIG. 2. Note that a concrete manufacturing method and the like of photosensitive drum 1 is described in detail later.

Charge roller 2 is formed, for example, of a metal shaft of stainless steel or the like and a semi-conductive epichlorohydrin rubber. Charge roller 2 is made to be in contact with photosensitive drum 1 by a certain pressure. In addition, charge roller 2 is configured to evenly charge the surface of photosensitive drum 1 according to a certain voltage applied from a high-voltage power supply, while rotating in a direction indicated by an arrow in FIG. 2.

Development roller 3 is formed, for example, by laying polyurethane rubber, in which carbon black is dispersed, on an outer circumference of a metal shaft of stainless steel or the like, and subjecting the surface thereof to isocyanine treatment. Moreover, development roller 3 is disposed to be in pressure contact with the surface of photosensitive drum 1. Furthermore, development roller 3 is configured to rotationally feed toner T to an electrostatic latent image formed on the surface of photosensitive drum 1 while rotating in the direction indicated by an arrow in FIG. 2, and develop the toner image by a reversal development.

Development blade 4 is a plate member formed of a metal plate of stainless steel or the like, for example, and an end thereof is disposed to be in contact with a predetermined portion of the surface of development roller 3. Development blade 4 is configured to limit a layer thickness of toner T fed from sponge roller 5.

Sponge roller 5 is formed, for example, by laying a semi-conductive foam silicone sponge layer on an outer circumference of a metal shaft of stainless steel or the like. Sponge roller 5 is disposed to be in pressure contact with the surface of development roller 3. Moreover, sponge roller 5 is configured to agitate and charge toner T fed from toner cartridge 7 while rotating in the direction indicated by an arrow in FIG. 2, and to feed charged toner T to development roller 3.

Cleaning blade 6 is a polyurethane rubber member, for example, and an end thereof is disposed to be in contact with a predetermined portion of the surface of photosensitive drum 1. Cleaning blade 6 is configured to clean the surface of photosensitive drum 1 by scraping off residual toner T from the surface of photosensitive drum 1.

Optical static eliminator 30 includes: a lens array; light sources including LED elements, laser elements and the like disposed at approximately even intervals along an entrance plane of the lens array; and a charge elimination light control part configured to control the emission timing and emission amount of the light sources. In this embodiment, the lens array includes an exit plane from which the light, having entered from the entrance plane, exits as charge elimination light, and is configured so that the length of the exit plane in the longitudinal direction is approximately the same as the length of photosensitive drum 1 in the axial direction. Note that optical static eliminator 30 is disposed between charge roller 2 and cleaning blade 6 so that the radiated charge elimination light can cover an entire electrostatic latent image formation region on the surface of photosensitive drum 1.

Note that point P (see FIG. 1) where transfer roller 21 and photosensitive drum 1 make contact with each other via transfer belt 14 therebetween is called image transfer point A where the toner image is transferred from photosensitive drum 1 to print medium P. Point B (see FIG. 1) where photosensitive drum 1 and charge roller 2 make contact with each other is called charge position B where the surface of photosensitive drum 1 is charged by charge roller B.

In the embodiment, rotation angle θ measured from image transfer position A to charge position B is 125 degree. That is, a travel distance L that a part of the surface of photosensitive drum 1 travels from image transfer position A to charge position B is 32.7 [mm], because $L=r\cdot\theta$ (rad)$=15\cdot(125\pi/180)=32.7$ [mm].

Figure 3:
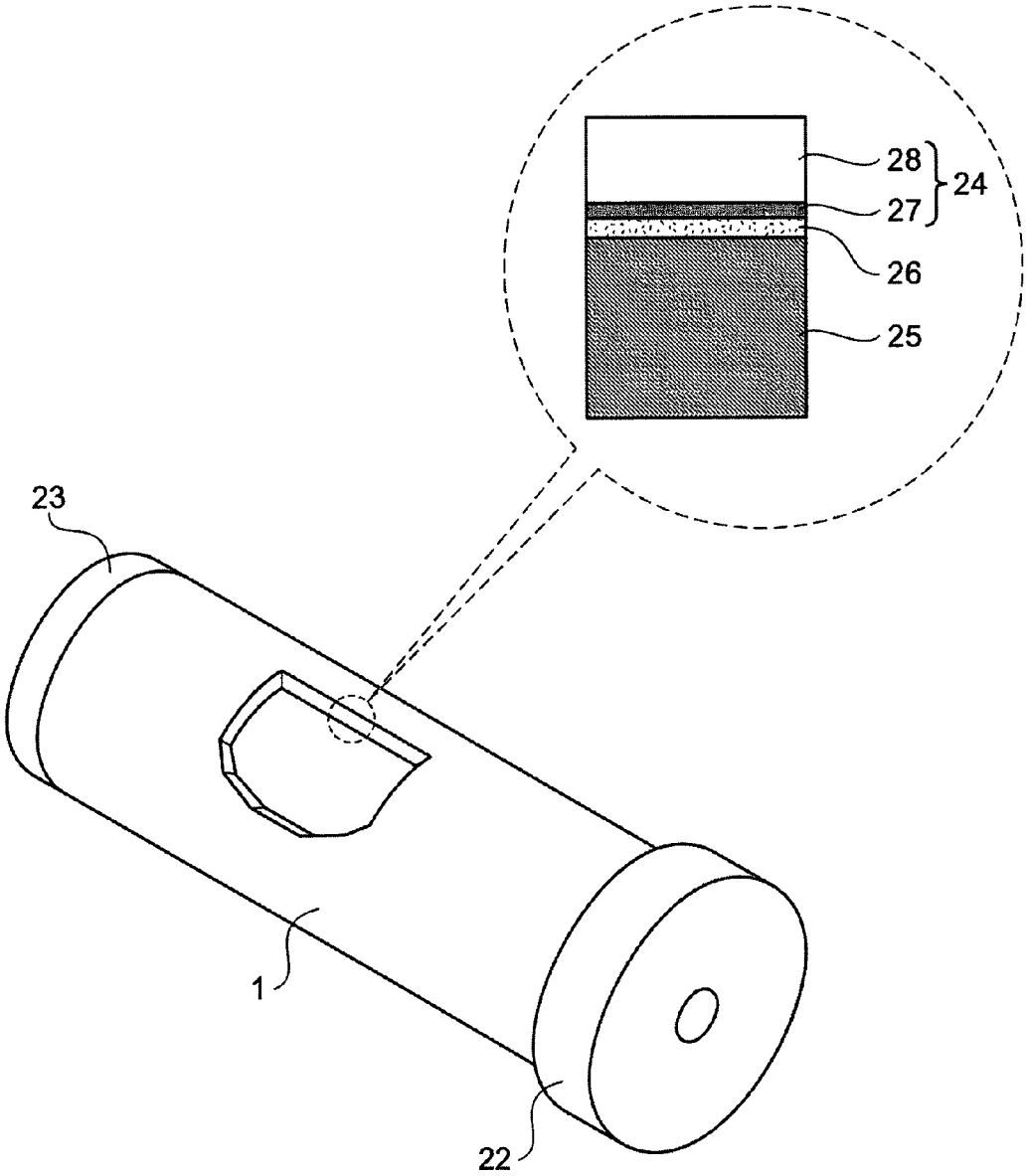
FIG. 3 is a schematic configuration diagram for explaining a configuration of a photosensitive drum.

Next, a configuration of photosensitive drum 1 according to the embodiment is described. FIG. 3 is a schematic configuration diagram for explaining the configuration of photosensitive drum 1.

Photosensitive drum 1 has a configuration including drum gear 22, drum flange 23, and conductive substrate 25 processed into a cylindrical shape and whose surface has the following layers stacked thereon. Specifically, blocking layer 26, charge generation layer 27, and charge transport layer 28 are stacked in this order on the surface of photosensitive drum 1, charge generation layer 27 and charge transport layer 28, being collectively referred to as photosensitive layer 24.

Figure 4:
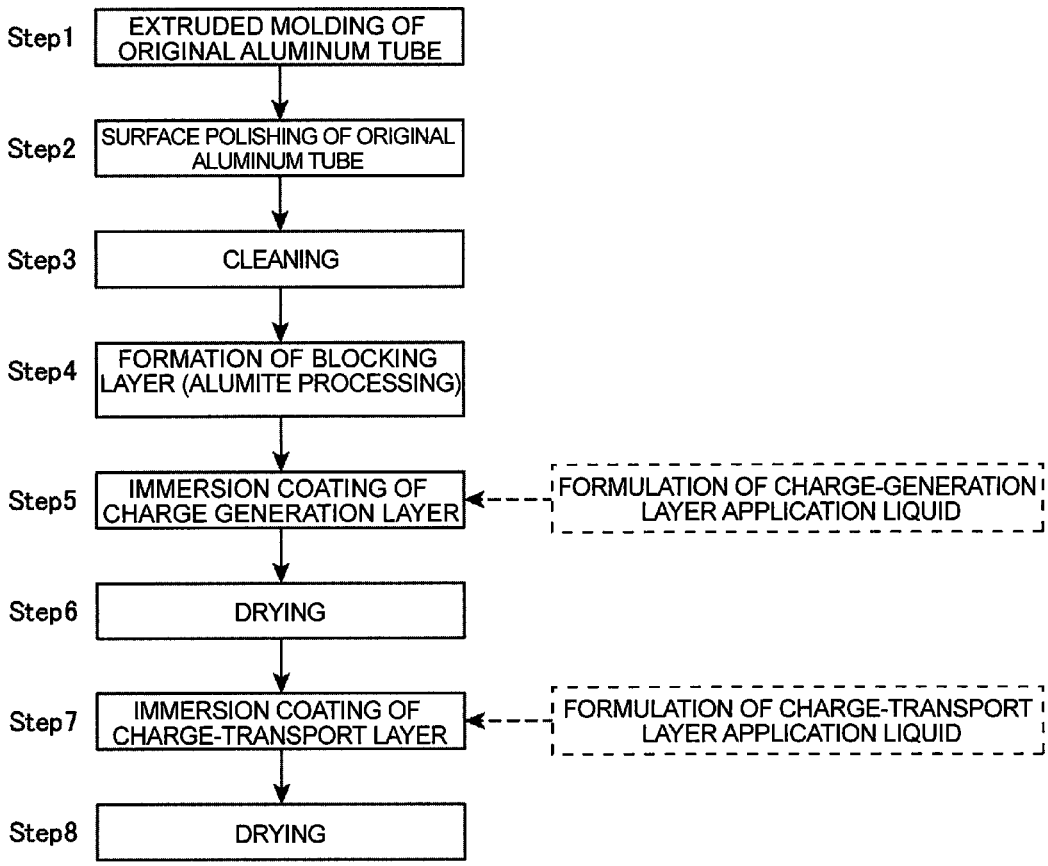
FIG. 4 is a flowchart for explaining a manufacturing procedure of a photosensitive drum.

A manufacturing procedure of photosensitive drum 1 with the above configuration is described by use of the flowchart of FIG. 4.

Firstly, in Step 1, an aluminum alloy, being a raw material of the conductive substrate, is processed into an extruded cylindrical tube by a porthole die. In this embodiment, the aluminum alloy is a JIS-A300-series aluminum alloy billet which is an alloyed metal made by mixing aluminum and silicon or the like.

Then, in Step 2, the extruded cylindrical tube obtained in Step 1 is cut and processed to have a predetermined wall-thickness and outer diameter. In this embodiment, conductive substrate 25 is an original aluminum tube with an outer diameter of 30 mm, a length of 246 mm, and a wall-thickness of 0.75 mm (called original aluminum tube 25 below).

Thereafter, in Step 3, original aluminum tube 25 obtained in Step 2 is subjected to a surface cleaning process to adequately remove oil and various dust in the air, for example, from the surface of original aluminum tube 25.

Then, blocking layer 26 is formed on the thoroughly-cleaned surface of original aluminum tube 25. In this embodiment, an anodization process is performed to form blocking layer 26, and then a sealing process is performed by using nickel acetate as a main component. The thus formed anodic oxide film is regarded as blocking layer 26 (called alumite layer 26 below) (Step 4).

In Step 5, charge generation layer 27 is formed on alumite layer 26 obtained in Step 4. Charge generation layer 27 is formed by immersion coating, where original aluminum tube 25 on which alumite layer 26 is formed is dipped in a tank filled with a previously-formulated charge-generation layer application liquid to apply the liquid. In this embodiment, charge generation layer 27 is applied to form a film thickness of approximately 0.3 μm. Note that the charge-generation layer application liquid used in this embodiment is a liquid in which: 10 parts of oxytitanium phthalocyanine are added to 150 parts of 1,2-Dimethoxyethane; a binder solution of 5% solid content concentration, including five parts of polyvinyl butyral dissolved in 95 parts 1,2-Dimethoxyethane, is mixed with 160 parts of pigment dispersion made through a disintegration and dispersion process by a sand grinding mill. The liquid is adjusted to finally have a solid content concentration of 4% and a ratio of 1,2-Dimethoxyethane to 4-Methoxy-4-methylpentanone-2 of 9 to 1.

Thereafter, original aluminum tube 25, including charge generation layer 27 applied on alumite layer 26, is dried to remove residual solvent in charge generation layer 27 and fix charge generation layer 27 onto alumite layer 26 (Step 6).

Then, in Step 7, charge transport layer 28 is formed on charge generation layer 27 obtained in Step 6. Charge transport layer 28 is formed by immersion coating, where original aluminum tube 25, on which charge generation layer 27 is formed, is dipped in a tank filled with a previously-formulated charge-transport layer application liquid to apply the liquid. The charge-transport layer application liquid is a liquid in which mainly a binder resin and a charge transporter are dissolved in a solvent. In this embodiment, sample photosensitive drums are manufactured by the use of charge-transport layer application liquids described below.

Thereafter, original aluminum tube 25, including charge transport layer 28 applied on charge generation layer 27, is dried to remove residual solvent in charge transport layer 28 and fix charge transport layer 28 onto charge generation layer 27 (Step 8).

In this embodiment, sample photosensitive drums are manufactured according to a manufacturing procedure shown in FIG. 4, and are used in the following consideration.

<Sample 1>

A liquid is used as the charge-transport layer application liquid in which: 100 parts of a polycarbonate resin, shown in structural formula 1 as a binder resin, and 70 parts of a charge transporter, shown in structural formula 6 as the charge transporter, are dissolved in a mixed solvent where the ratio of tetrahydrofuran to toluene is 80 to 20. A sample photosensitive drum whose photosensitive layer has a film thickness of 20 μm is manufactured according to the aforementioned manufacturing procedure shown in the flowchart of FIG. 4.

[Chem. 1]

(Structural Formula 1)

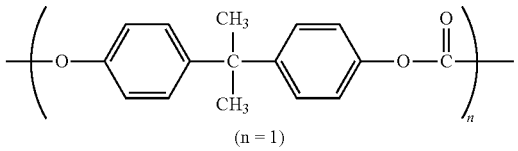

(n = 1)

[Chem. 2]

-continued (Structural Formula 6)

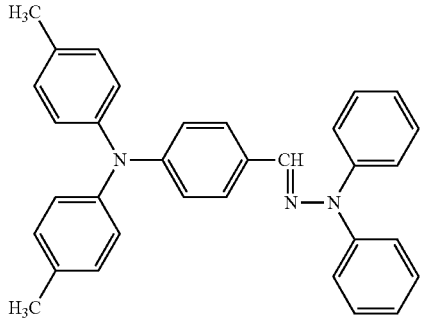

<Sample 2>

A liquid is used as the charge-transport layer application liquid in which: 100 parts of a polycarbonate resin, shown in structural formula 2 as a binder resin, and 70 parts of a charge transporter, shown in structural formula 7 as the charge transporter, are dissolved in a mixed solvent where the ratio of tetrahydrofuran to toluene is 80 to 20. A sample photosensitive drum whose photosensitive layer has a film thickness of 20 μm is manufactured according to the aforementioned manufacturing procedure shown in the flowchart of FIG. 4.

[Chem. 5]

(Structural Formula 3)

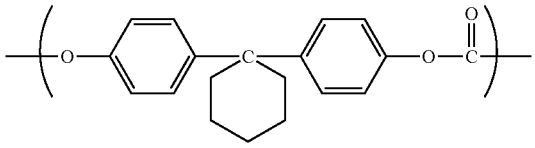

[Chem. 6]

(Structural Formula 8)

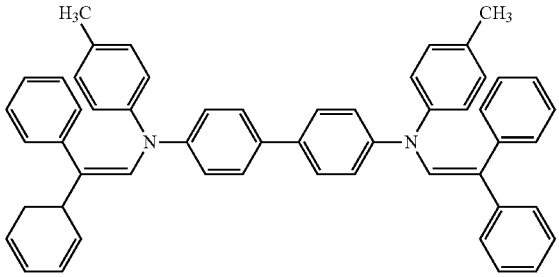

[Chem. 3]

(Structural Formula 2)

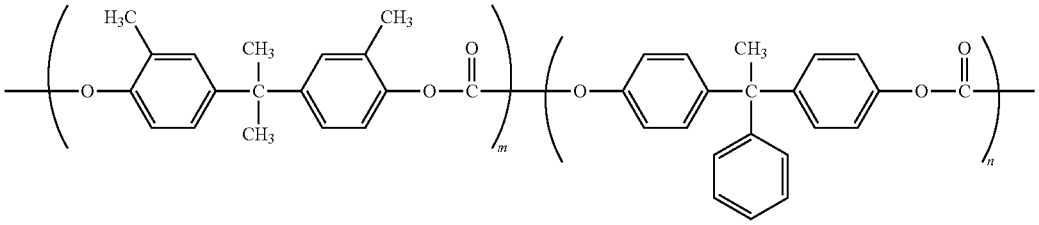

(m:n = 1:1)

[Chem. 4]

(Structural Formula 7)

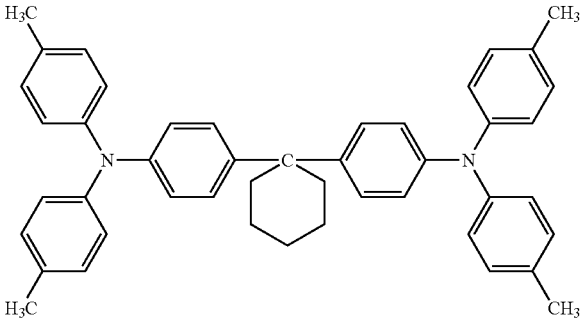

<Sample 3>

A liquid is used as the charge-transport layer application liquid in which: 100 parts of a polycarbonate resin, shown in structural formula 3 as a binder resin, and 70 parts of a charge transporter, shown in structural formula 8 as the charge transporter, are dissolved in a mixed solvent where the ratio of tetrahydrofuran to toluene is 80 to 20. A sample photosensitive drum whose photosensitive layer has a film thickness of 20 μm is manufactured according to the aforementioned manufacturing procedure shown in the flowchart of FIG. 4.

<Sample 4>

A liquid is used as the charge-transport layer application liquid in which: 30 parts of a polycarbonate resin, shown in structural formula 1, and 70 parts of polyarylate resin shown in structural formula 4 as binder resins, and 50 parts of charge transporter shown in structural formula 6 and 20 parts of charge transporter shown in structural formula 9 as charge transporters, and a part of additive shown in structural formula 10 as an additive, are dissolved in a mixed solvent where the ratio of tetrahydrofuran to toluene is 80 to 20. A sample photosensitive drum whose photosensitive layer has a film thickness of 20 μm is manufactured according to the aforementioned manufacturing procedure shown in the flowchart of FIG. 4.

[Chem. 7]

(Structural Formula 4)

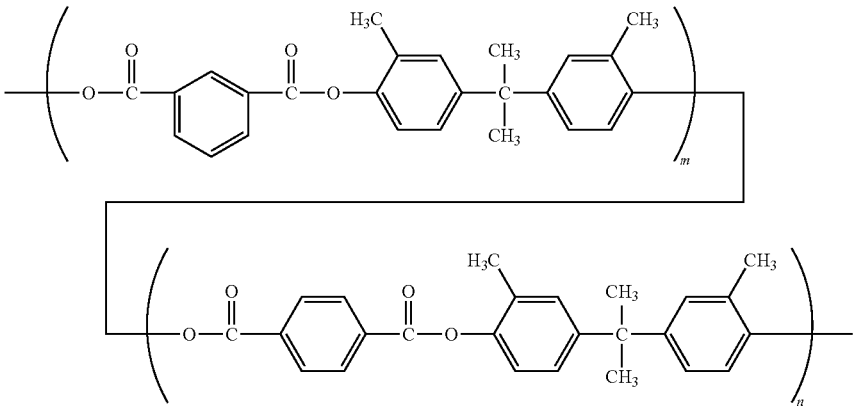

(m:n = 1:1)

[Chem. 8]

(Structural Formula 9)

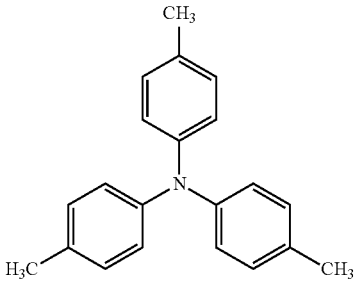

[Chem. 9]

(Structural Formula 10)

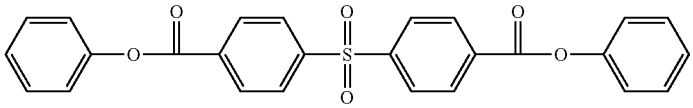

<Sample 5>

A liquid is used as the charge-transport layer application liquid in which: 30 parts of a polycarbonate resin shown in structural formula 2 and 70 parts of a polyarylate resin shown in structural formula 4 as binder resins, and 50 parts of a charge transporter shown in structural formula 7 and 20 parts of a charge transporter shown in structural formula 9 as charge transporters, and a part of additive shown in structural formula 10 as an additive, are dissolved in a mixed solvent where the ratio of tetrahydrofuran to toluene is 80 to 20. A sample photosensitive drum whose photosensitive layer has a film thickness of 20 μm is manufactured according to the aforementioned manufacturing procedure shown in the flowchart of FIG. 4.

<Sample 6>

A liquid is used as the charge-transport layer application liquid in which: 30 parts of a polycarbonate resin shown in structural formula 3 and 70 parts of a polyarylate resin shown in structural formula 4 as binder resins, and 50 parts of a charge transporter shown in structural formula 8 and 20 parts of a charge transporter shown in structural formula 9 as charge transporters, and a part of additive shown in structural formula 10 as an additive, are dissolved in a mixed solvent where the ratio of tetrahydrofuran to toluene is 80 to 20. A sample photosensitive drum whose photosensitive layer has a film thickness of 20 μm is manufactured according to the aforementioned manufacturing procedure shown in the flowchart of FIG. 4.

<Sample 7>

A liquid is used as the charge-transport layer application liquid in which: 30 parts of a polycarbonate resin shown in structural formula 1 and 70 parts of a polyester resin shown in structural formula 5 as binder resins, and 50 parts of a charge transporter shown in structural formula 6 as a charge transporter, are dissolved in a mixed solvent where the ratio of tetrahydrofuran to toluene is 80 to 20. A sample photosensitive drum whose photosensitive layer has a film thickness of 15 μm is manufactured according to the aforementioned manufacturing procedure shown in the flowchart of FIG. 4.

[Chem. 10]

(Structural Formula 5)

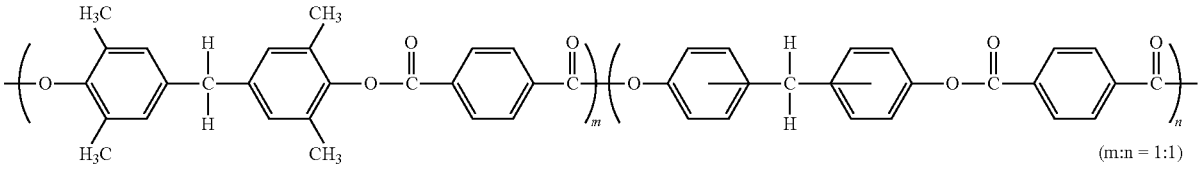

(m:n = 1:1)

<Sample 8>

A liquid is used as the charge-transport layer application liquid in which: 30 parts of a polycarbonate resin shown in structural formula 2 and 70 parts of a polyester resin shown in structural formula 5 as binder resins, and 50 parts of a charge transporter shown in structural formula 7 as a charge transporter, are dissolved in a mixed solvent where the ratio of tetrahydrofuran to toluene is 80 to 20. A sample photosensitive drum whose photosensitive layer has a film thickness of 15 μm is manufactured according to the aforementioned manufacturing procedure shown in the flowchart of FIG. 4.

<Sample 9>

A liquid is used as the charge-transport layer application liquid in which: 30 parts of a polycarbonate resin shown in structural formula 3 and 70 parts of a polyester resin shown in structural formula 5 as binder resins, and 50 parts of a charge transporter shown in structural formula 8 as a charge transporter, are dissolved in a mixed solvent where the ratio of tetrahydrofuran to toluene is 80 to 20. A sample photosensitive drum whose photosensitive layer has a film thickness of 15 μm is manufactured according to the aforementioned manufacturing procedure shown in the flowchart of FIG. 4.

<Sample 10>

A liquid is used as the charge-transport layer application liquid in which: 100 parts of a polycarbonate resin shown in structural formula 1 as a binder resin, and 40 parts of a charge transporter shown in structural formula 6 and 10 parts of a charge transporter shown in structural formula 9 as charge transporters, and a part of additive shown in structural formula 10 as an additive, are dissolved in a mixed solvent where the ratio of tetrahydrofuran to toluene is 80 to 20. A sample photosensitive drum whose photosensitive layer has a film thickness of 15 μm is manufactured according to the aforementioned manufacturing procedure shown in the flowchart of FIG. 4.

<Sample 11>

A liquid is used as the charge-transport layer application liquid in which: 100 parts of a polycarbonate resin shown in structural formula 2 as a binder resin, and 40 parts of a charge transporter shown in structural formula 7 and 10 parts of a charge transporter shown in structural formula 9 as charge transporters, and a part of additive shown in structural formula 10 as an additive, are dissolved in a mixed solvent where the ratio of tetrahydrofuran to toluene is 80 to 20. A sample photosensitive drum whose photosensitive layer has a film thickness of 15 μm is manufactured according to the aforementioned manufacturing procedure shown in the flowchart of FIG. 4.

<Sample 12>

A liquid is used as the charge-transport layer application liquid in which: 100 parts of a polycarbonate resin shown in structural formula 3 as a binder resin, and 40 parts of a charge transporter shown in structural formula 8 and 10 parts of a charge transporter shown in structural formula 9 as charge transporters, and a part of additive shown in structural formula 10 as an additive, are dissolved in a mixed solvent where the ratio of tetrahydrofuran to toluene is 80 to 20. A sample photosensitive drum whose photosensitive layer has a film thickness of 15 μm is manufactured according to the aforementioned manufacturing procedure shown in the flowchart of FIG. 4.

Next, an image formation process of printer 100 having the above configuration is described.

Firstly, upon input of print data to printer 100, printer 100 initiates the image formation process. On initiation of the image formation process, print medium P accommodated in feeder cassette 10 is fed out onto the sheet conveyance path, one sheet at a time, by rotation of feeder roller 11. Print medium P fed out by feeder roller 11 is nipped and conveyed by conveyance roller 12, and is then conveyed to image formation units 15 while its obliqueness is being corrected by conveyance roller 13. After that, the following image formation process is initiated at a certain timing before print medium P is conveyed to image formation units 15.

Upon generation of image data for printer 100, photosensitive drum 1 rotates at a predetermined circumferential speed in the direction indicated by the arrow in FIG. 2. Then, charge roller 2, disposed to be in contact with the surface of photosensitive drum 1, applies a −1200V charge bias, for example, applied from the high-voltage power supply to the surface of photosensitive drum 1. Thus, the charge roller 2 evenly charges the surface. Subsequently, exposure LED head 20, disposed to face the surface of photosensitive drum 1, radiates radiation light corresponding to the image data, and the potential of the part irradiated with light optically attenuates to form an electrostatic latent image.

Development roller 3 is disposed to be in pressure contact with photosensitive drum 1 as described above, and a −300V development bias is applied thereto from a high-voltage power supply, for example. Development roller 3 adsorbs toner T conveyed by sponge roller 5 and applied with a −450V feeder bias, for example, and rotationally conveys toner T. In this rotational conveyance process, development blade 4, disposed downstream of sponge roller 5 and in pressure contact with development roller 3, evens out toner T adsorbed onto development roller 3, and forms a toner layer.

Then, development roller 3 performs reversal-development of the electrostatic latent image formed on the surface of photosensitive drum 1 by use of toner T. Since a bias voltage is applied between the conductive substrate of photoconductive drum 1 and development roller 3 by the high-voltage power supply, an electric flux line corresponding to the electrostatic latent image formed on photosensitive drum 1 is generated between photosensitive drum 1 and development roller 3. Accordingly, charged toner T on development roller 3 is attached to the electrostatic latent image portion of photosensitive drum 1 by electrostatic force, and thus a toner image is formed.

Next, the toner image formed on photosensitive drum 1 is transferred onto print medium P by transfer roller 21 to which a +1100V transfer bias, for example, is applied from the high-voltage power supply.

Thereafter, print medium P is conveyed to fixture unit 16 including fixture roller 161 and pressure roller 162. Print medium P onto which the toner image is transferred is conveyed to a pressure contact part formed of fixture roller 161 and pressure roller 162, fixture roller 161 being kept at a predetermined surface temperature. Then, toner T melts by heat applied from fixture roller 161, and with pressure from the pressure contact part, the toner image is fixed onto print medium P.

Print medium P onto which the toner image is fixed is nipped and conveyed by conveyance roller 17, and then delivered by delivery roller 18 to delivery unit 19.

Note that a small amount of toner T may be left on the surface of photosensitive drum 1 after transfer of the toner image in some cases. Residual toner T is removed by cleaning blade 6. As described above, cleaning blade 6 is disposed to be in contact with a predetermined portion, or part, of the surface of photosensitive drum 1. An amount of toner T which is not transferred and is left on the surface of photosensitive drum 1 is removed by the rotation of photosensitive drum 1 with cleaning blade 6 in contact with the surface of photosensitive drum 1.

Then, optical static eliminator 30 radiates a certain radiation light as an amount of charge elimination light to reset the potential on the surface of photosensitive drum 1, and awaits the next image formation process.

Thus, printer 100 according to the embodiment forms an image by carrying out the following set of processes as a cycle. Specifically, the processes include: charging the surface of photosensitive drum 1 by charge roller 2; exposing the surface of photosensitive drum 1 to light by exposure LED head 20; developing by development roller 3, development blade 4, and sponge roller 5 serving as developing devices; transferring by transfer roller 21, and eliminating the charges by optical static eliminator 30.

Figure 5:
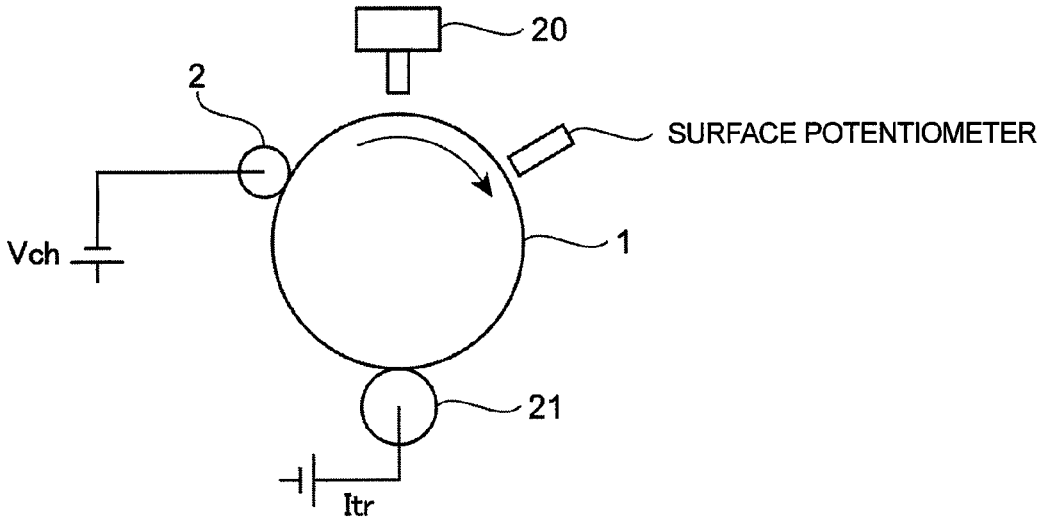
FIG. 5 is a schematic configuration diagram for describing a measurement device for measuring an electrical characteristic of sample photosensitive drums.

Next, a description is given of an electrical characteristic of the sample photosensitive drums, considered to provide an image formation apparatus capable of suppressing the occurrence of ghosts. FIG. 5 is a schematic configuration diagram for describing a measurement device for measuring the electrical characteristic of the aforementioned sample photosensitive drums.

The measurement device is a modification mainly of image formation unit 15 of printer 100. The modified image formation unit includes charge roller 2 and a sample photosensitive drum serving as photosensitive drum 1, with a surface potentiometer disposed between exposure LED head 20 and transfer roller 21. Note that the surface potentiometer is disposed at the same position as development roller 3 of unmodified image formation unit 15.

By installing the modified image formation unit to a modified printer, an image formation process based on print data inputted from outside can be operated. Operations of the thus modified printer only include the steps of: charging by charge roller 2; exposing by exposure LED head 20; and transferring by transfer roller 21. A surface potential value of the operating sample photosensitive drum can be measured by the surface potentiometer. In addition, the modified printer has a configuration in which voltage Vch applied to charge roller 2 and transfer current Itr sent to transfer roller 21 can be set arbitrarily.

Figure 6:
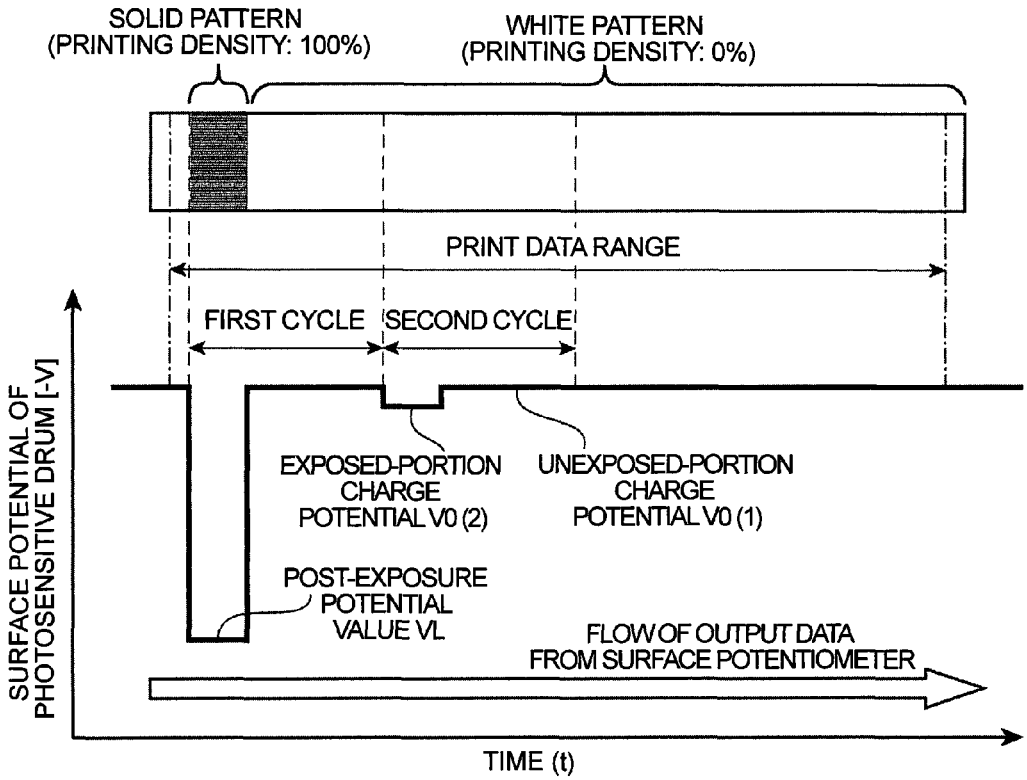
FIG. 6 is a schematic diagram showing the transition of a surface potential value of the sample photosensitive drum outputted from a surface potentiometer.

FIG. 6 shows: a schematic diagram of print data, which is transmitted from the outside to the measurement device (modified printer) shown in FIG. 5; and a schematic diagram showing the transition of the surface potential value of the sample photosensitive drum, outputted from the surface potentiometer in the image formation process based on the print data.

As shown in FIG. 6, the print data according to the embodiment includes a solid pattern portion of 100% printing density, and a white pattern portion of 0% printing density. To be specific, the solid pattern portion is positioned at the beginning of a print area range of print medium P, in a range corresponding to approximately half of a length of a first drum cycle (first rotation of the drum). Meanwhile, the white pattern portion is positioned in a range corresponding to the length of the remaining approximately half, as well as the second drum cycle (second rotation of the drum) and following drum cycles.

In the first drum cycle, the surface potential value outputted from the surface potentiometer according to the print data transitions from post-exposure surface potential value VL [V] at the solid pattern portion, to a charge potential value, obtained in the charge step, at the white pattern portion. Then, in the second drum cycle, the charge potential value of a surface portion of the drum corresponding to the solid pattern portion in the first drum cycle (exposed-portion charge potential) takes $V_0(\mathbf{2})$ [V]; and the charge potential value of a surface portion of the drum corresponding to the white pattern portion in the first drum cycle (unexposed-portion charge potential) takes $V_0(\mathbf{1})$ [V].

If a cycle of an image formation process does not include a charge elimination step, the difference between above-mentioned charge potential value $V_0(\mathbf{2})$ [V] and charge potential value $V_0(\mathbf{1})$ [V] is the cause of ghosts. The charge elimination step by the optical static eliminator is provided in order to suppress occurrence of such ghosts. The optical static eliminator generally radiates a certain amount of charge elimination light to reset the potential difference between charge potential value $V_0(\mathbf{2})$ [V] and charge potential value $V_0(\mathbf{1})$ [V]. However, due to the further size reduction and speed improvement of the apparatus in recent years, space between the transfer unit and the charge unit inevitably becomes small. Accordingly, since the distance between the optical static eliminator and the charge unit is shortened, the processing proceeds to the charge step before the charges in the surface of the photoreceptor are sufficiently eliminated by the optical static eliminator in some cases.

However, according to the electrical characteristic of the photosensitive drum, it is difficult to just uniformly set a favorable condition for preventing the occurrence of ghosts by using the potential difference between charge potential value $V_0(\mathbf{2})$ [V] and charge potential value $V_0(\mathbf{1})$ [V], that is, using value $|V_0(\mathbf{1})-V_0(\mathbf{2})|$. This is because the influence that the set value has on the charge potential obtained in the charge step differs among image formation apparatuses. Specifically, assume that the favorable potential difference for preventing the occurrence of ghosts is set as $|V_0(\mathbf{1})-V_0(\mathbf{2})|\leq 50$ [V], and a comparison is made between image formation apparatuses whose charge potential values obtained in the charge step are respectively set to −800 [V] and −400 [V]. Here, the above specified value of 50 [V] is very small relative to the charge value set in the former device, and is not so large as an image formation process condition that a ghost should occur. On the other hand, the specified value of 50 [V] is quite large relative to the charge value set in the latter device, and is so large as an image formation process condition that a ghost may occur. Accordingly, to specify the influence that the potential difference between charge potential value $V_0(\mathbf{2})$ [V] and charge potential value $V_0(\mathbf{1})$ [V] has on ghost occurrence, it is more appropriate to specify the influence by a ratio of charge potential value $V_0(2)$ [V] to charge potential value $V_0(1)$ [V].

By the way, the electrical characteristic of the photosensitive drum can be determined by post-exposure surface potential value VL [V] of the surface portion of the photoreceptor, as a result of the following steps. Specifically, charges generated in the charge generation layer in the exposure step move to the surface of the photosensitive drum via the charge transport layer, and electrification charges deposited on the surface of the photosensitive drum in the charge step are offset.

However, if film thickness L [μm] of the photosensitive layer is large, the travel distance of the charge is elongated, and thus post-exposure surface potential value VL [V] differs by the film thickness of the photosensitive layer even under the same measurement conditions. Hence, the electrical characteristic of the photosensitive drum is, instead, determined by electric field strength per unit film thickness of photosensitive layer |VL|/L. Note that since the photosensitive layer is an organic substance, it is easily affected by temperature or humidity, and thus movement of the charges in the photosensitive layer slows down in a low-temperature and low-humidity environment. In such an environment, the electrical characteristic becomes significant so to largely influence ghost occurrence.

As described above, the difference between charge potential value $V_0(2)$ [V] (exposed-portion charge potential) of the surface portion of the drum in the second drum cycle, and charge potential value $V_0(1)$ [V] (unexposed-portion charge potential) of the surface portion of the drum in the second drum cycle is the cause of ghosts. Moreover, another cause of ghosts is an amount of charges retained in the charge transport layer in the exposure step and the charge elimination step in the first drum cycle, with the charges having been generated in the charge generation layer. In other words, if value |VL|/L mentioned earlier is excessively large, this means that a large amount of charges are retained in the photosensitive layer corresponding to the exposed portion in the first drum cycle. Hence, even if there is no difference between charge potential value $V_0(2)$ [V] (exposed-portion charge potential) of the surface portion of the drum in the second drum cycle, and charge potential value $V_0(1)$ [V] (unexposed-portion charge potential) of the surface portion of the drum in the second drum cycle, an image defect still occurs. More specifically, due to the retained charges, the charges generated in the charge generation layer at the exposed portion in the first drum cycle move slower than the charges generated in the charge generation layer at the unexposed portion in the first drum cycle, creating a difference in the post-exposure surface potentials therebetween. Thus, the exposed portion of the first drum cycle is printed more faintly in the resultant printed image, which is the image defect generally referred to as a negative ghost. In contrast, if value |VL|/L is excessively small, the amount of retained charges is reversed from the case where value |VL|/L is excessively large, creating a difference in the post-exposure surface potentials in the second drum cycle. Thus, the exposed portion in the first drum cycle is printed more heavily in the resultant print image, which is an image defect generally referred to as a positive ghost.

According to the above perception, an electrical characteristic condition achieving suppression of ghost occurrence is considered by: measuring post-exposure surface potential value VL [V], charge potential value $V_0(2)$ [V] (exposed-portion charge potential) of a surface portion of the drum, and charge potential value $V_0(1)$ [V] (unexposed-portion charge potential) of a surface portion of the drum, of a manufactured sample photosensitive drum by the measurement device (modified printer) in FIG. 5; and calculating the value $(|V_0(2)-VL|)/(|V_0(1)-VL|)$ and the value |VL|/L.

The measurement conditions are as follows.

rotation speed of photosensitive drum: 127 rpm time from charge step to exposure step: 0.059 seconds (s)

time from exposure step to surface potentiometer: 0.079 s time from surface potentiometer to transfer step: 0.157 s time from transfer step to charge step: 0.177 s amount of exposure light: 0.8 μj/cm$^2$ wavelength of exposure light: 760 nm temperature/humidity: 10° C./20% transfer current (Itr): 20 μA (optimal current setting in the embodiment)

charge voltage (Vch): set for each sample photosensitive drum so that the surface potential is −500V when the transfer current is OFF (Itr=0 μA).

Here, in image formation apparatus 100, if the conveyance speed of print medium P is to be made faster, the rotation speed of photosensitive drum 1 is made faster in proportion to the conveyance speed. The embodiment shows an example where the rotation speed of the sample photosensitive drum is set to 127 rpm. However, the same result is obtained in the above range when the same test is carried out with this measurement device by changing the rotation speed of the photosensitive drum in the range of 90 to 180 rpm. This indicates that the effects of the embodiment are obtained when the photosensitive drum satisfying conditions which bring about a favorable result with the measurement device in FIG. 5 is mounted on image formation apparatus 100 and rotated in the range of 90 to 180 rpm.

Note that the above measurement conditions are normal conditions set in an image formation process in the measurement device (modified printer) used in the embodiment. However, conditions are not limited to the above, and as long as the rotation speed of the photosensitive drum is in the range of 90 to 180 rpm, various image formation apparatuses including an optical static eliminator disposed between a transfer unit and a charge unit can be used as the measurement device in FIG. 5, even with a different positional relationship among components of the image formation apparatus. In such cases, the distance from the transfer step to the charge step may be set to 0.177 s or less.

Figure 7:
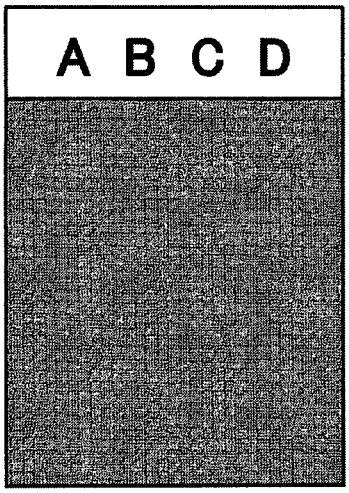
FIG. 7 is a view explaining a print pattern.

Using printer 100 shown in FIG. 1, ghost occurrence evaluation is made by printing a print pattern as shown in FIG. 7 under a low temperature and low humidity (temperature/humidity: 10° C./20%) environment. If a favorable result is obtained under the low-temperature and low-humidity environment, a favorable result is also obtained under a normal-temperature and normal-humidity (such as temperature/humidity: 23° C./50%) or a high-temperature and high-humidity (such as temperature/humidity 40° C./93%) environment. The print pattern shown in FIG. 7 is: printed on an A4 PPC paper for general office use in portrait orientation; where a pattern of a bold character string on a white background is formed within an approximately 50 mm lengthwise area of the paper measured from the top edge of the printable area; and a halftone pattern of 30% printing density is formed in an area below the 50 mm upper area and hence that is lower than the area of the prior pattern; or in other words, the halftone pattern is formed in an area on the paper that is more than 50 mm down from the top edge of the printable area of the paper. The amount of radiated charge elimination light in the ghost occurrence evaluation is 2.4 μj/cm$^2$, and conditions are set for a normal image formation process, except that the charge voltage is set for each sample photosensitive drum by using the aforementioned value set in the measurement by the measurement device.

Figure 8:
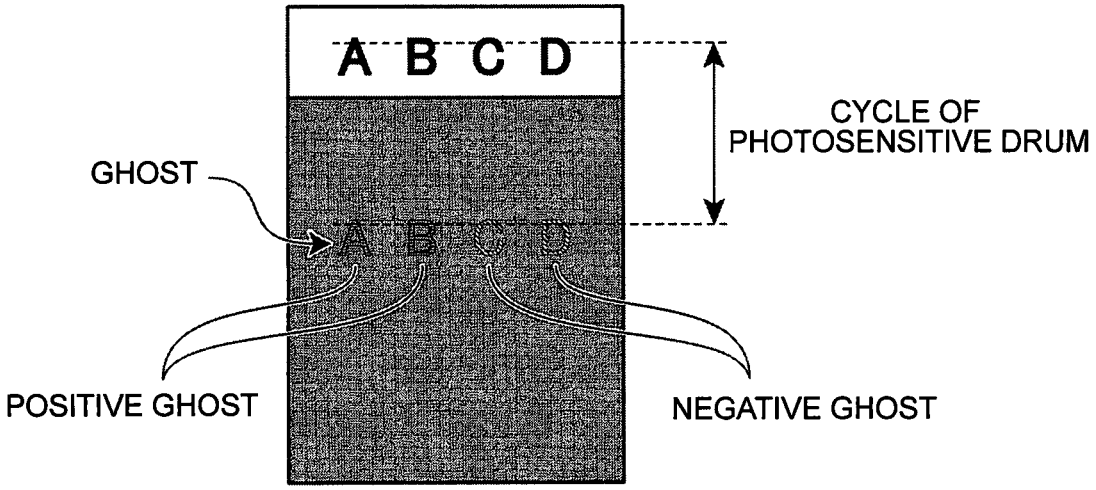
FIG. 8 is a view explaining a determination reference for determining whether or not a ghost occurs.

Whether or not a ghost occurs can be determined by observing a halftone print portion in the second photosensitive drum rotation of a photosensitive drum cycle shown in FIG. 8. To be precise, the determination is made by whether or not a potential difference between an exposed portion corresponding to the bold character string pattern of the first photosensitive drum rotation and an unexposed portion corresponding to the white background appears as print.

Here, as a reference for the determination, a level at which a ghost print is visually unrecognizable is determined as ○, and a level at which a ghost print is visually recognizable and problematic for practical use is determined as x. In addition, a case where a ghost print appears faintly as in FIG. 8 is determined as the occurrence of a negative ghost, and where a ghost print appears distinctly as in FIG. 8 is determined as the occurrence of a positive ghost.

FIG. 9 is a table showing values concerning manufactured sample photosensitive drums and respective results of ghost-level evaluation. Specifically, the values include: post-exposure surface potential value VL [V]; charge potential value $V_0(\mathbf{2})$ [V] (exposed-portion charge potential) of the surface portion of the drum; charge potential value $V_0(\mathbf{1})$ [V] (unexposed-portion charge potential) of the surface portion of the drum; value $(|V_0(\mathbf{2})-VL|)/(|V_0(\mathbf{1})-VL|)$; and value $|VL|/L$.

As shown in FIG. 9, among the manufactured sample photosensitive drums, a positive ghost is observed for samples 1, 2 and 12, and a negative ghost is observed for sample 7. Meanwhile, no ghost is observed and a favorable result is obtained for samples 3, 4, 5, 6, 8, 9, 10, and 11.

Moreover, in consideration of the test result of FIG. 9, a similar test is carried out by setting the value of $(|V_0(\mathbf{2})-VL|)/(|V_0(\mathbf{1})-VL|)$ to around 0.9 and around 1.0. As a result, it is confirmed that when the value of $(|V_0(\mathbf{2})-VL|)/(|V_0(\mathbf{1})-VL|)$ is smaller than 0.9 a positive ghost occurs, and when larger than 1.0 a negative ghost occurs. Here, the value of $(|V_0(\mathbf{2})-VL|)/(|V_0(\mathbf{1})-VL|)$ is obtained according to the perception that the cause of the ghost occurrence is the difference between charge potentials, with the influence of retained charges being ignored.

In addition, it is confirmed that when the value of $|VL|/L$ is smaller than 2.0 a positive ghost occurs, and when larger than 3.5, a negative ghost occurs. Here, the value of $|VL|/L$ is obtained according to the perception that the cause of the ghost occurrence is the retained charges.

From these results, according to an image formation apparatus using the photosensitive drum satisfying both formulae $$0.9 \le (|V_0(2)-VL|)/(|V_0(1)-VL|) \le 1.0 \quad \text{(Formula 1) and}$$

$$2.0 \le |VL|/L \le 3.5 \quad \text{(Formula 2),}$$

the occurrence of ghosts can be suppressed even when it is difficult to obtain a sufficient charge elimination effect in the charge elimination step, because the space between a transfer unit and a charge unit is reduced along with a size reduction and speed improvement of the image formation apparatus.

Further, the same good or similar result is obtained even when the external environment around the image formation apparatus greatly changes, if the photosensitive drum satisfies both formulae:

$$0.9 \le (|V_0(2)-VL|)/(|V_0(1)-VL|) \le 0.98 \quad \text{(Formula 1') and}$$

$$2.5 \le |VL|/L \le 3.5 \quad \text{(Formula 2').}$$

More preferably, the photosensitive drum satisfies both formulae:

$$0.92 \le (|V_0(2)-VL|)/(|V_0(1)-VL|) \le 0.97 \quad \text{(Formula 1") and}$$

$$2.5 \le |VL|/L \le 3.0 \quad \text{(Formula 2").}$$

In the first embodiment, as shown in FIGS. 1 and 2, printer 100 is equipped with eliminator 30. However, the invention is not limited to this configuration. For example, a photoreceptor employing the invention can effectively suppress the occurrence of ghost to an extent, even if a printer does not include a charge elimination unit such as eliminator 30.

Second Embodiment

The second embodiment defines an optimal radiation amount of charge elimination light in an image formation apparatus using a photosensitive drum satisfying both formulae, (Formula 1) and (Formula 2), shown in the first embodiment, to suppress the occurrence of ghosts and also to maintain favorable printing quality over time.

In general, when the amount of radiated charge elimination light is excessively large, the electrical characteristic of the photosensitive drum deteriorates by optical fatigue due to print durability, and it is known that printing defects, such as lowered printing concentration and lowered contrast, occur over time. In this embodiment, an evaluation is made on ghost occurrence and printing quality other than that due to ghost occurrence, at the time of initial printing and after printing 20K sheets. The evaluations are made under conditions of a normal image formation process, except for the following conditions: to set references of the radiation amount of charge elimination light to 0 μj/cm$^2$, 0.5 μj/cm$^2$, 0.6 μj/cm$^2$, 1.2 μj/cm$^2$, 2.4 μj/cm$^2$, 4.8 μj/cm$^2$, 5.0 μj/cm$^2$, and 7.2 μj/cm$^2$; to use printer 100 shown in FIG. 1; and to use the charge voltage set in the measurement by the measurement device (modified printer) carried out for each sample photosensitive drum in the first embodiment.

Ghost occurrence evaluation is made at the times of initial printing and after printing 20K sheets, as in the case of the first embodiment, by using printer 100 shown in FIG. 1 under a low-temperature and low-humidity (temperature/humidity: 10° C./20%) environment, and printing the pattern as shown in FIG. 7. The print pattern in FIG. 7 is: printed on an A4 PPC paper for general office use in portrait orientation; where a pattern of a bold character string on a white background is formed within approximately the first 50 mm length of the paper measured from the top edge of the printable area; and a halftone pattern of 30% printing density is formed in an area lower than the approximately 50 mm from the top edge of the printable area.

Whether or not a ghost occurs can be determined by observing a halftone print portion in the second photosensitive drum rotation of a photosensitive drum cycle shown in FIG. 8. To be precise, the determination is made by whether or not a potential difference between an exposed portion corresponding to the bold character string pattern of the first photosensitive drum rotation and an unexposed portion corresponding to the white background appears as print.

Here, as a reference for the determination, a level at which a ghost print is visually unrecognizable is determined as ○, and a level at which a ghost print is visually recognizable and problematic for practical use is determined as x. In addition, a case where a ghost print appears faintly as in FIG. 8 is determined as the occurrence of a negative ghost, and where a ghost print appears distinctly as in FIG. 8 is determined as the occurrence of a positive ghost.

As for the evaluation of printing quality other than that caused by (or attributable to) ghost occurrence, a level at which printing defects such as lowered printing concentration and lowered contrast are visually unrecognizable is determined as ○, and a level at which the printing defects are visually recognizable and problematic for practical use is determined as x.

FIGS. 10-1 and 10-2 show tables indicating the results of ghost occurrence evaluation and evaluation on printing quality other than that due to ghost occurrence at the time of the initial printing, for the 12 types of sample photosensitive drums shown in the first embodiment.

As shown in FIGS. 10-1 and 10-2, in the ghost occurrence evaluation at the time of the initial printing, a ghost occurs for all 12 types of sample photosensitive drums when the radiation amount of charge elimination light is 0 μj/cm$^2$. In addition, no ghost is observed with the radiation amount of 0.6 μj/cm$^2$ or more and a favorable result is obtained for the sample photosensitive drums satisfying the formulae (Formula 1) and (Formula 2) of the first embodiment, which are samples 3, 4, 5, 6, 8, 9, 10, and 11. Moreover, no printing defect is observed except for the ghost at the time of the initial printing.

FIGS. 11-1 and 11-2 show tables indicating the results of ghost occurrence evaluation and evaluation on printing quality other than that due to ghost occurrence after printing 20K sheets (plate life), for the 12 types of sample photosensitive drums shown in the first embodiment.

As shown in FIGS. 11-1 and 11-2, in the ghost occurrence evaluation after printing 20K sheets (plate life), a ghost occurs for all 12 types of sample photosensitive drums when the radiation amount of charge elimination light is 0 μj/cm$^2$. In addition, a ghost is observed with the radiation amounts of 0.5 μj/cm$^2$, 5.0 μj/cm$^2$, and 7.2 μj/cm$^2$ for the sample photosensitive drums satisfying the formulae (Formula 1) and (Formula 2) of the first embodiment, which are samples 5, 9, and 10.

In the evaluation on printing quality other than that due to ghost occurrence after printing 20K sheets (plate life), printing defects such as a lowered printing concentration and a lowered contrast are observed for all 12 types of sample photosensitive drums when the radiation amount of charge elimination light is 7.2 μj/cm$^2$. In addition, the printing defects are visually recognizable with the radiation amount of 0.5 μj/cm$^2$, for samples 1, 4, 5, 8, 9, and 12.

According to the above results, occurrence of ghosts can be suppressed and favorable printing quality can be maintained over time by using an image formation apparatus provided with the photosensitive drum satisfying the formulae (Formula 1) and (Formula 2) of the first embodiment, and including the charge elimination step in which the amount of charge elimination light is within the range of not less than 0.6 μj/cm$^2$, and not more than 4.8 μj/cm$^2$.

Further, the same good or similar result is obtained even when the external environment around the image formation apparatus greatly changes, if the amount of charge elimination light is within the range of not less than 1.0 μj/cm$^2$ and not more than 3.8 μj/cm$^2$, and more preferably, is within the range of not less than 1.6 μj/cm$^2$ and not more than 3.2 μj/cm$^2$.

In the above second embodiment, the printer is equipped with eliminator 30 as shown in FIGS. 1 and 2. However, the invention is not limited to this configuration. For example, a photoreceptor employing the invention can effectively suppress the occurrence of ghost to an extent, even if a printer does not include a charge elimination unit such as eliminator 30.

Modification

Note that in the above embodiments, rotational angle θ from image transfer position A (see, FIG. 1) to charge position B (see, FIG. 1) is 125 degree. Travel distance L that a part of the surface of photosensitive drum 1 rotationally travels from image transfer position A to charge position B is 32.7 [mm].

However, this is only one example. The same or similar effects can be obtained with rotational angle θ of 90 to 160 degrees and distance L of 18 to 47 [mm]

Although the description of the embodiments are given by taking a printer as an example of the image formation apparatus including the optical static eliminator, the invention is not limited to this. The invention is also applicable to an image formation apparatus employing electrophotographic processing other than the printer, such as a copy machine, a facsimile, and an MFP.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus for forming an image comprising:

a photoreceptor including a surface comprising a photosensitive layer;

a charge unit configured to charge the surface of the photoreceptor;

an exposure unit configured to emit light to the surface of the photoreceptor charged by the charge unit and to form an electrostatic latent image on the surface of the photoreceptor;

a development unit configured to feed a developer to the electrostatic latent image and thereby develop a developer image on the surface of the photoreceptor; and a transfer unit configured to transfer the developer image onto a transfer target, wherein the photoreceptor satisfies both of the following formulae:

$$0.9 \le (|V_0(2)-VL|)/(|V_0(1)-VL|) \le 1.0,$$

and $$2.0 \le |VL|/L \le 3.5$$

where

VL denotes a post-exposure surface potential value [V] of a surface portion of the photoreceptor exposed by the exposure unit in a first image formation cycle, $V_0$(2) denotes a charge potential value [V] in a second image formation cycle of a surface portion of the photoreceptor exposed by the exposure unit in the first image formation cycle, $V_0$(1) denotes a charge potential value [V] in a second image formation cycle of a surface portion of the photoreceptor not exposed by the exposure unit in the first image formation cycle, and L denotes a film thickness [μm] of the photosensitive layer.

2. The image formation apparatus according to claim 1, wherein the photoreceptor satisfies both of the following formulae:

$$0.9 \le (|V_0(2)-VL|)/(|V_0(1)-VL|) \le 0.98, \text{ and}$$

$$1.5 \le |VL|/L \le 3.5.$$

3. The image formation apparatus according to claim 1, wherein the photoreceptor satisfies both of the following formulae:

$$0.92 \leq (|V_0(2)-VL|)/(|V_0(1)-VL|) \leq 0.97, \text{ and}$$

$$2.5 \leq |VL|/L \leq 3.0.$$

4. The image formation apparatus according to claim 1, further comprising a charge elimination unit configured to emit charge elimination light to the surface of the photoreceptor, wherein the charge elimination unit is provided between the transfer unit and the charge unit.

5. The image formation apparatus according to claim 1, wherein a distance L that the surface of the photoreceptor travels from an image transfer position between the photoreceptor and the transfer unit to a charge position between the photoreceptor and the charge unit is not less than 18 [mm] and not more than 47 [mm].

6. The image formation apparatus according to claim 5, wherein the photoreceptor is configured to rotate at a rotational speed in the range of from 90 to 180 rpm.

7. The image formation apparatus according to claim 1, further comprising a charge elimination unit configured to emit charge elimination light to the surface of the photoreceptor, wherein an amount of the charge elimination light is at least not less than 0.6 $\mu j/cm^2$ and not more than 4.8 $\mu j/cm^2$.

8. The image formation apparatus according to claim 1, further comprising a charge elimination unit configured to emit charge elimination light to the surface of the photoreceptor, wherein the amount of the charge elimination light is at least not less than 1.0 $\mu j/cm^2$ and not more than 3.8 $\mu j/cm^2$.

9. The image formation apparatus according to claim 1, further comprising a charge elimination unit configured to emit charge elimination light to the surface of the photoreceptor, wherein the amount of the charge elimination light is at least not less than 1.6 $\mu j/cm^2$ and not more than 3.2 $\mu j/cm^2$.

10. The image formation apparatus according to claim 1, wherein the charge unit comprises a charge roller, and the transfer unit comprises a transfer roller.

11. The image formation apparatus according to claim 10, wherein the development unit comprises a development roller.

12. The image formation apparatus according to claim 10, further comprising a transfer belt provided between the photoreceptor and the transfer roller.

13. The image formation apparatus according to claim 1, wherein the potential values of the surface of the photoreceptor are measured at a position on the surface of the photoreceptor where the development unit is disposed.

14. The image formation apparatus according to claim 1, further comprising a charge elimination unit configured to emit charge elimination light to the surface of the photoreceptor, wherein the image formation apparatus is configured to form an image by performing, as a cycle, the steps of: charging by the charge unit; exposing by the exposure unit; developing by the development unit; transferring by the transfer unit; and eliminating charges by the charge elimination unit.

15. The image formation apparatus according to claim 1, further comprising a charge elimination unit configured to emit charge elimination light to the surface of the photoreceptor, wherein the image formation apparatus is configured to form an image by performing, as a cycle, the steps of: charging by the charge unit; exposing by the exposure unit; developing by the development unit; transferring by the transfer unit; and eliminating charges by the charge elimination unit, in this order.

* * * * *